United States Patent [19]

Gibson

[11] Patent Number: 4,544,437

[45] Date of Patent: Oct. 1, 1985

[54] LABEL PRINTING DEVICE

[75] Inventor: William K. Gibson, Winnipeg, Canada

[73] Assignee: R.W. Packaging, Ltd., Winnipeg, Canada

[21] Appl. No.: 673,992

[22] Filed: Nov. 21, 1984

Related U.S. Application Data

[63] Continuation of Ser. No. 449,841, Dec. 14, 1982, abandoned.

[51] Int. Cl.[4] ..... B41F 13/04

[52] U.S. Cl. ..... 156/584; 101/228; 226/144

[58] Field of Search ..... 101/66, 92, 228, 245, 101/219; 226/8, 152, 155, 120, 144; 156/584

[56] References Cited

U.S. PATENT DOCUMENTS

| | | | |
|---|---|---|---|
| 901,996 | 10/1908 | Parker | 101/92 X |
| 2,633,773 | 4/1953 | Frederick | 226/144 |
| 2,671,397 | 3/1954 | Gorbatenko | 101/228 |
| 2,824,736 | 2/1958 | Allen | 101/66 X |
| 2,999,456 | 9/1961 | Lanegan | 101/228 |
| 3,145,890 | 8/1964 | Gordon et al. | 226/144 X |
| 3,461,984 | 8/1969 | Phillips et al. | 101/228 X |
| 3,507,726 | 4/1970 | Crew | 156/584 X |
| 4,276,112 | 6/1981 | French et al. | 101/228 X |

FOREIGN PATENT DOCUMENTS

| | | | |
|---|---|---|---|
| 580906 | 9/1946 | United Kingdom | 101/228 |

*Primary Examiner*—Clifford D. Crowder
*Attorney, Agent, or Firm*—Lyon & Lyon

[57] ABSTRACT

A intermediate feed mechanism in a label printing device enables correct registry of a printing plate with successive labels on a strip material backing, and easy adjustment of the intermittent feed in accordance with the label size, in a very simple and inexpensive manner. A drive wheel releasably secured for rotation with a print cylinder is provided, around only a portion of its periphery, with gear teeth for successive driving engagement with gear teeth around the entire periphery of a driven wheel secured for rotation with an impression cylinder, so that the latter is driven only while the gear teeth on the driving wheel are driven into contact with those on the driven wheel. The intermittent drive mechanism may also be employed in a label dispenser.

10 Claims, 7 Drawing Figures

LABEL PRINTING DEVICE

This is a continuation of application Ser. No. 449,841, filed Dec. 14, 1982, now abandoned the entire disclosure of which is incorporated herein by reference.

FIELD OF THE INVENTION

The present invention relates to intermittent feed mechanisms and is useful in particular, but not exclusively, for effecting intermittent feeding of label-bearing strip material in a label printing device or a label dispenser.

DESCRIPTION OF THE PRIOR ART

In prior art roll feed label printing presses, one of the most troublesome and waste-causing problems is the difficulty involved in controlling the register of the strip material webs passing through the presses during the printing cycles and the eventual winding up of the printed strip material web on a take-up roll.

More particularly, label printing is usually effected in such a press by passing a label-bearing strip material web around an impression cylinder, between the impression cylinder and a plate cylinder carrying a printing plate, which is inked. For accurate printing of the labels, it is necessary to ensure correct registry of the printing plate and the successive labels, which are spaced apart along the strip material, during simultaneous passage of each successive label and the printing plate through the nip between the impression cylinder and the printing plate cylinder.

The strip material is provided from a supply roll and, as the diameter of the roll of strip material on the supply roll decreases, and that on the take-up roll increases, it becomes very difficult to maintain the correct registry between the printing plate and the labels.

In an effort to overcome this difficulty, prior art presses have been provided with a very expensive air or electric clutches, throughout the presses, and, in cases where a very fine registry was required, photoelectric sensing devices have been provided in the presses.

Even with such complicated and expensive equipment, stopping and restarting of the presses, after relaxation of the strip material, causes many feet of the strip material to run out of registry, and thus to be wasted, until the tension in the strip material is restored to its required condition.

OBJECTS OF THE INVENTION

It is accordingly an object of the present invention to provide a novel and improved intermittent feeding mechanism which, in a simple and inexpensive manner, facilitates accurate registry of a printing plate with successive labels in a label printing device.

It is a further object of the present invention to provide a simple intermittent feed mechanism in a label dispensing device for automatically stripping successive labels from a backing strip.

BRIEF SUMMARY OF THE INVENTION

According to the present invention, there is provided a label printing device comprising a supply roll means for rotatably supporting a roll of strip material; take-up roll means for receiving the strip material from the supply roll means; an impression cylinder rotatable about a first axis; means for guiding the strip material from the supply roll means around the impression cylinder to the take-up roll means; a print cylinder co-operating with the impression cylinder, the print cylinder being rotatable about a second axis parallel to the first axis; means for rotating the print cylinder; a printing plate on the print cylinder for printing onto the strip material as the strip material passes around the impression cylinder; means for applying ink to the printing plate; and means for intermittently rotating the impression cylinder from the print cylinder; the drive means comprising first formations rotatable with the impression cylinder and second formations rotatable with the print cylinder, and interengageable with the first formations; the first formations being uniformly distributed around the entire periphery of the impression cylinder and the second formations being similarly uniformly distributed around only a portion of the periphery of the print cylinder; and the second formations being successively engageable with the first formations for rotating the impression cylinder on rotation of the second formations past the impression cylinder, whereby the impression cylinder remains undriven during rotation of the remainder of the periphery of the print cylinder past the impression cylinder.

The formations may, for example, comprise gear teeth or radially projecting pins on driving and driven wheels secured, in a readily releasable manner, to the print cylinder and the impression cylinder, respectively.

Thus, by substituting for the driving wheel a different driving wheel, having a different number of teeth projecting therefrom, the device can be readily, quickly and inexpensively adapted to the printing of different label sizes.

BRIEF DESCRIPTION OF THE DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
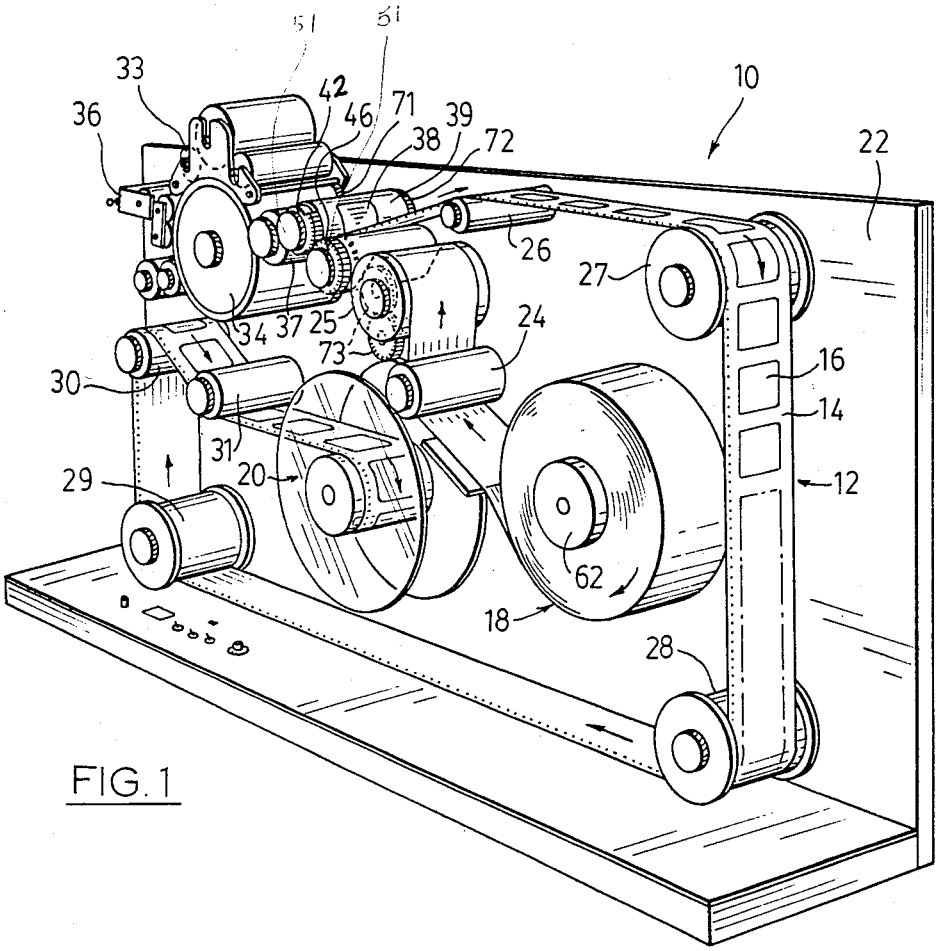
FIG. 1 shows a view in perspective of a label printing device.

Referring firstly to FIG. 1 of the accompanying drawings, there is illustrated a label printing device indicated generally by reference numeral 10 in which a web, indicated generally by reference numeral 12 and comprising a strip of backing material 14 bearing, spaced apart along the length thereof, a plurality of labels 16, is fed from a supply roll indicated generally by reference numeral 18 to a take-up roll indicated generally by reference numeral 20.

The supply roll 18 and the take-up roll 20 are rotatably mounted on a back plate 22, on which are also rotatably mounted guide rolls 24 to 31 for guiding the web 12 from the supply roll 18 to the take-up roll 20.

Ink dressing rollers 33 co-operating with an ink supply roll 34 are provided for applying ink from an ink reservoir 36 via an ink transfer roll 37 to a rubber printing plate 38, which is releasably secured to a printing roll or cylinder 39.

The plate 38 is slightly proud of the printing cylinder 39 and co-operates with an impression cylinder 40 to define a nip at which printing of the successive labels 16 occurs. A clearance is provided between the impression cylinder 40 and printing cylinder 39 to allow free rotation of one relative to the other when the plate 38 is not in engagement with the cylinder 40.

As will be readily apparent to those skilled in the art, it is important to ensure that the printing plate 38 is brought into accurate registry with each successive one of the labels 16 as the latter pass through the nip between the print cylinder 39 and the impression cylinder 40.

For this purpose, a drive wheel 42 is secured to the print cylinder 39 and a driven wheel 46 is secured to the impression cylinder 40 by longitudinal pins 49 that engage in recesses 50 in the respective cylinders. The cylinders 39 and 40 are freely rotatable on shafts 43 and 44 which project from the back plate 22 and knobs 51 threaded onto the shafts to retain the cylinders 39, 40.

The knobs 51 can be replaced by any readily releasable means, for example wing nuts, for retaining the wheels 42 and 46 to their respective cylinders.

Figure 3:
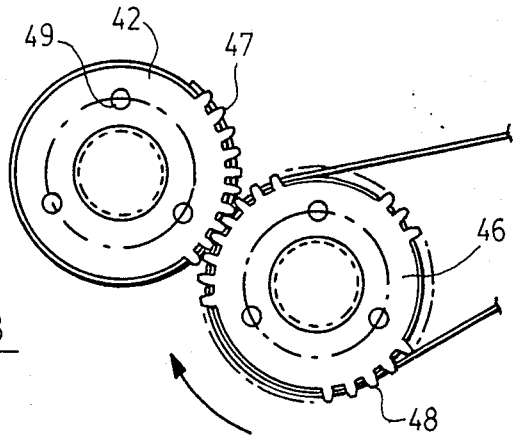
FIG. 3 shows a view in front elevation of a pair of gear wheels forming parts of the device of FIG. 1.

As can be seen from FIG. 3, the drive wheel 42 is provided with gear teeth 47 distributed over only a portion of the periphery of the driving wheel 42 corresponding generally to the location of the plate 38.

The driven wheel 46 is provided with gear teeth 48 meshing with the gear teeth 47 and distributed around the entire periphery of the drive wheel 46.

When the drive wheel 42 is rotated, in the direction indicated by an arrow thereon in FIG. 3, the leading one of the teeth 47 will move into contact with and drive one of the gear teeth 48, and the next following tooth 47 will subsequently move into contact with and drive the next following tooth 48, and so forth, until the trailing tooth 47 has driven and separated from the respective tooth 48. Thus, the driven wheel 46 will be caused to rotate during such engagement of the teeth 47 with the teeth 48. However, as indicated above, the teeth 47 are distributed only around a portion of the periphery of the driving wheel 42 and, while the remainder of the periphery of the driving wheel 42 passes by the driven wheel 46, the latter will not be rotated by the driving wheel 42. In this way, intermittent rotation of the driven wheel 46 is effected.

The distance through which the driven wheel 46 is rotated during each rotation of the driving wheel 42 corresponds to the peripheral length of the toothed portion of the periphery of the drive wheel 42. This distance is, of course, selected so as to correspond to the length of one label 16 and the spacing between successive labels 16, measured longitudinally of the web 12, so that one label 16 is printed during each rotation of the drive wheel 42.

Also, the device can be readily adapted to different label lengths by replacing the drive wheel 42 by a different drive wheel, having a different number of gear teeth, in order to effect a correspondingly different rotary displacement of the driven wheel 46 during each rotation of the drive wheel 42.

The web 12 is provided, along one marginal edge portion thereof, with successive holes 52 for engagement by the pins 53 (FIG. 2) on the impression cylinder 40, so that the web 12 moves conjointly with impression cylinder 40 as the printing plate 38 engages the web 12 to print the label 16. In this way, accurate registry of the printing plate 38 with the labels 16 is ensured.

The supply roll 18 is provided with a brake 62 for maintaining a suitable tension in the web 12 between the supply roll 118 and the impression cylinder 40.

Figure 4:
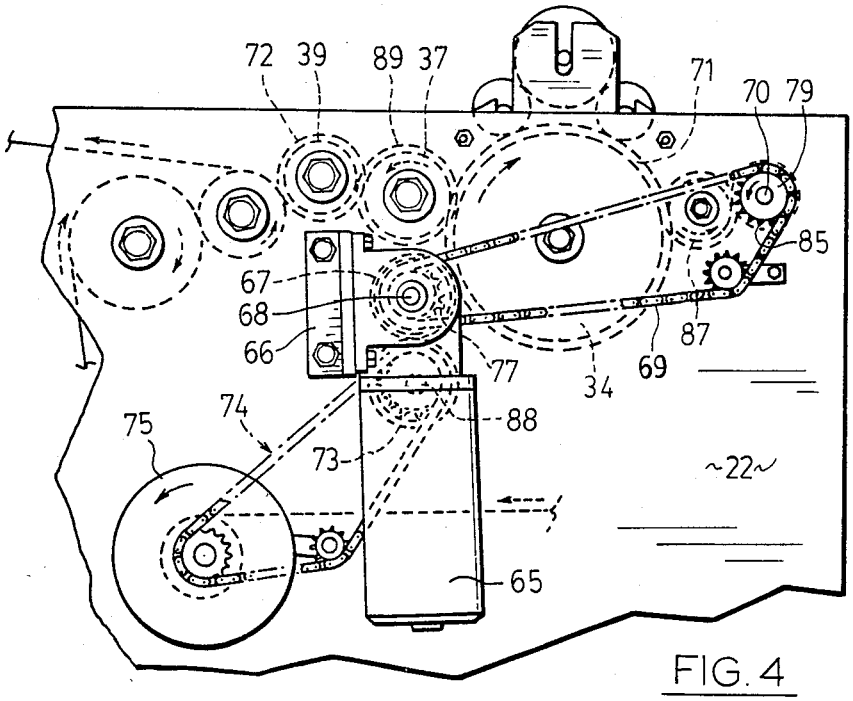
FIG. 4 shows a partly broken-away rear view, of the device of FIG. 1.

The drive for the label printing device is best shown in FIG. 4, and includes an electric motor 65 mounted on the back plate 22 by means of a bracket 66. The motor 65 has a horizontal output shaft 68 on which is mounted a drive gear 67 and a sprocket 77. The sprocket 77 transfers drive through a chain 69, to a sprocket 79 fast with a shaft 70 carrying a roller of the ink reservoir 36. Mounted on the shaft 70 is a gear 85 that drives through an idler gear 87 a gear 71 on the inking roll 34, a gear 89 on the ink transfer roll 37 and a gear 72 on the printing cylinder 39 so that drive for the printing cylinder 39 and thus the driving wheel 42 is provided The gear 67 drives through a lay gear 73 and lay shaft 89 a chain and sprocket drive transmission indicated generally by reference numeral 74 and a friction clutch 75 that acts on the take-up roll 20 ro apply a constant take up torque to the roll 20.

In order to ensure that, when the trailing one of the driving teeth 47 disengages from its corresponding tooth 48 on the driven wheel 46, the driven wheel 46 immediately comes to rest and is not caused to continue to rotate by inertia, a click-stop or detent mechanism is provided for releasably retaining the driven wheel 46 against rotation.

Figure 5:
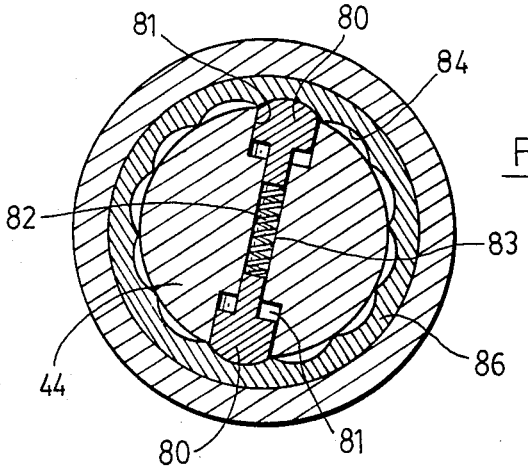
FIG. 5 shows a view in vertical cross-section through a detent mechanism forming part of the device of FIG. 1.
Figure 6:
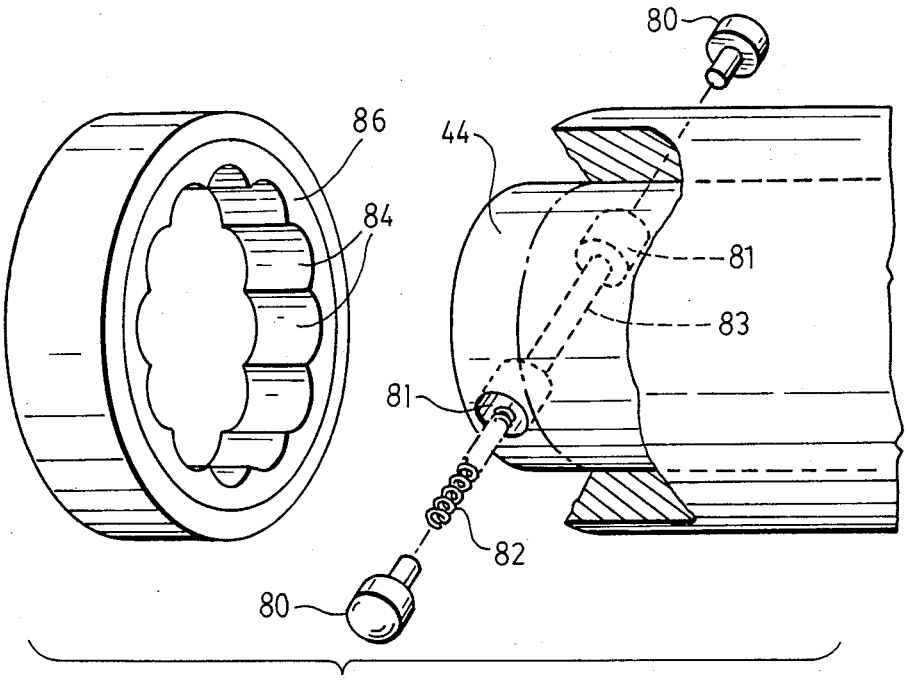
FIG. 6 shows a broken-away view in perspective of the mechanism of FIG. 5.

As shown in FIGS. 5 and 6, this click-stop or detent mechanism comprises a pair of detents 80 which project from counterbores 81 in the shaft 44 of the impression cylinder 40 and which are resiliently biased radially outwardly of tne counterbores 81 by means of a helical spring 82 accommodated in a bore 83 in the shaft 44.

The detents 80 slidably engage in detent recesses 84 distributed around the inner periphery of a sleeve 86, which is non-rotatably secured relative to the impression cylinder 40.

The detent recesses 84 are equiangularly spaced around the axis of rotation of the shaft 44 so that the driven wheel 42 is always arrested by the detent mechanism at a whole number of the increments provided by the spacing of the recesses 84 to ensure correct registry of the printing plate 38 with one of the labels 16.

Figure 7:
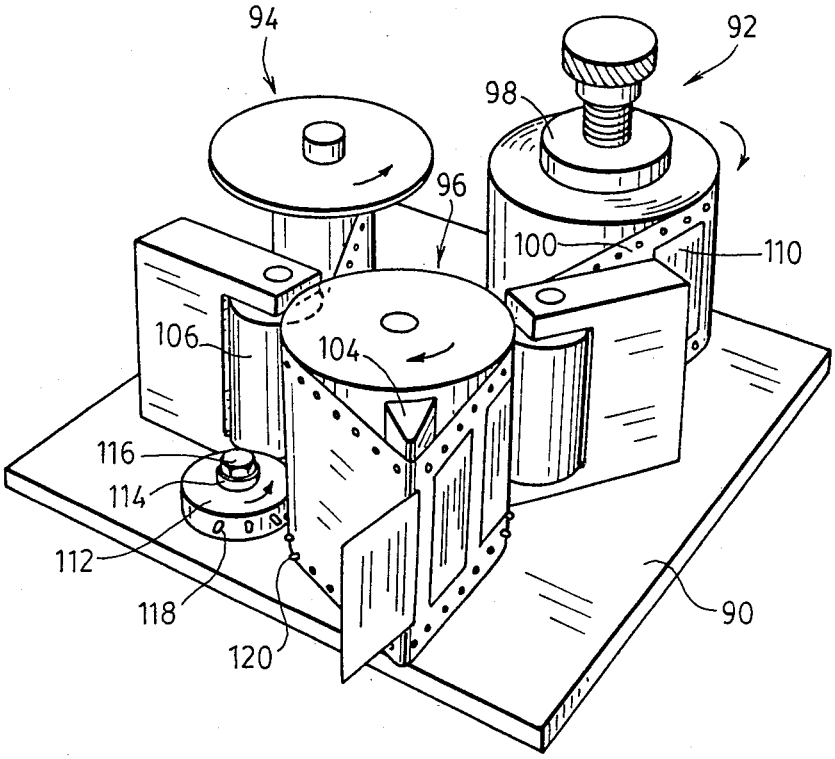
FIG. 7 shows a view in perspective of a label dispensing mechanism.

The label dispensing mechanism illustrated in FIG. 7 has a base plate 90, on which are mounted a supply roll indicated generally by reference numeral 92, a take-up roll indicated generally by reference numeral 94 and a driven roll indicated generally by reference numeral 96.

The supply roll 92 is provided with a slip clutch 98 for providing a tension in a web 100 as the latter is unwound from the supply roll 92.

From the supply roll 92, the web 100 is guided along a path of travel extending around a first pressing roller 102, the driven roller 96, a stationary stripper bar 104 adjacent the periphery of the driven roll 96, from which the web 100 returns to the periphery of the driven roll 96, and a second pressing roll 106 to the take-up roll 94. The pressing rollers 102 and 106 are spring-biased towards the driven roller 96 and thus against the web 100.

The stripper bar 104 is of wedge-shaped cross-section to define, in the path of travel of the web 100, a bend which is sufficiently sharp to cause labels 110 to become successively peeled from their backing sheet, which forms the web 100.

The driven roller 96 is rotated intermittently so as to peel each label 110 from the backing sheet in this way and so that, during each motion of the driven wheel 96, a corresponding one of the labels 110 is peeled almost entirely from the backing strip but remains adhering by its trailing edge portion to the backing strip, so that the label is supported projecting away from the blocking strip and the stripper bar 104, as illustrated in FIG. 7. The label is thus presented ready for adherence to an article (not shown) travelling along a different path of travel past the base plate 90.

The intermittent driving of the driven roller 96 is effected by means of a drive wheel 112, secured in a readily releasable manner by a nut 114 to a shaft 116, and having a plurality of drive pins 118 projecting radially from its periphery, over a portion of the periphery of the drive wheel 112, for engagement with pins 120 radially projecting from the driven roller 96 and distributed uniformly around the periphery of the driven roller 96.

Figure 2:
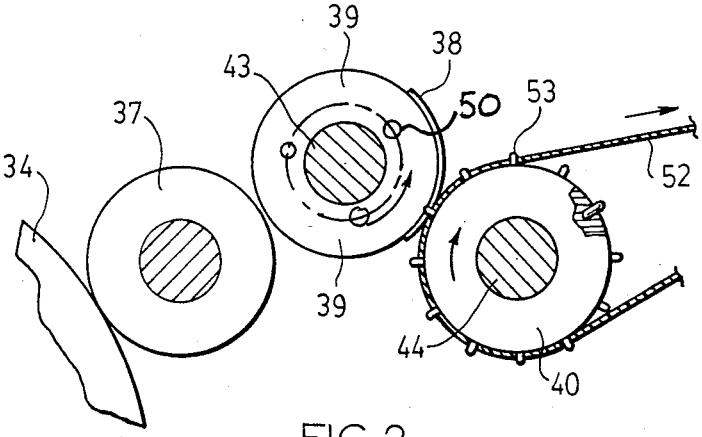
FIG. 2 shows a view in vertical cross-section, partly broken away, of components of the label printing device of FIG. 1.

As will be readily apparent from the above description of FIGS. 1 and 2, the drive wheel 112 is rotated at constant speed by an electric motor (not shown) to effect intermittent driving of the drive roll 96 by the successive engagements of the pins 118 with the pins 120.

The embodiments of the invention in which an exclusive property or privilege is claimed are defined as follows:

1. A label printing device, comprising:

a supply roll means for rotatably supporting a roll of strip material;

take-up roll means for receiving said strip material from said supply roll means;

an impression cylinder rotatable about a first axis;

means for guiding said strip material from said supply roll means around said impression cylinder to said take-up roll means;

a print cylinder co-operating with said impression cylinder, said print cylinder beipg rotatable about a second axis parallel to said first axis;

means for rotating said print cylinder;

a printing plate on said print cylinder for printing onto said strip material as said strip material passes around said impression cylinder;

means for applying ink to said printing plate;

means for intermittently rotationally driving said impression cylinder from said print cylinder; and braking means to inhibit rotation of said impression cylinder upon disengagement of said second formations from said first formations;

said drive means comprising first formations rotatable with said impression cylinder and second formations rotatable with said print cylinder and interengageable with said first formations;

said first formations being uniformly distributed around the entire periphery of said impression cylinder and said second formations being similarly uniformly distributed around only a portion of the periphery of said print cylinder;

said second formations being successively engageable with said first formations for rotating said impression cylinder, whereby said impression cylinder remains undriven during rotation of the remainder of the periphery of said print cylinder past said impression cylinder.

2. A label printing device as claimed in claim 1, said brake means comprising detent means for releasably arresting said impression cylinder in any one of a plurality of positions of rotation upon disengagement of said second formations from said first formations.

3. A label printing device as claimed in claim 1, further comprising a drive member and means readily releaseably securing said drive member for rotation with said print cylinder, said second formation being provided on the periphery of said drive member.

4. A label printing device as claimed in claim 3, wherein said second formations comprise gear teeth.

5. A label printing device as claimed in claim 1, wherein said first and second formations comprise gear teeth.

6. A label printing device as claimed in claim 1, 2 or 3, further comprising a driven member and means for releasably securing said driven member for rotation with said impression cylinder, said first formations comprising teeth on said driven member and equiangularly spaced around said first axis.

7. A label printing device as claimed in claim 1, wherein said impression cylinder has pins projecting radially of said first axis for engagement in holes spaced apart along said strip material.

8. An intermediate feed mechanism for advancing a label-bearing strip, comprising:

roll means for guiding said strip around said roll means;

said roll means having a plurality of radially outwardly projecting pins distributed around the periphery thereof for engagement in holes spaced apart along said strip and a plurality of radial second projection distributed around the periphery thereof;

a rotatable drive member for imparting intermittent rotary motion to said roll means;

braking means to inhibit rotation of said impression cylinder upon disengagement of said second formations from said first formations;

means for rotating said drive member;

said drive member having radial second projections distributed around only a portion of the periphery of said drive member for successive engagement with successive ones of said first projections, whereby said roll means ceases to be driven by said drive member during rotation of the remainder of the periphery of said drive member past said roll means; and means for readily replaceably securing said drive member to said roll means.

9. A label dispenser mechanism, comprising:

a supply roll for supporting a supply of a label-bearing strip material;

a take-up roll for receiving the strip material;

means for advancing said strip material along a path of travel from said supply roll to said take-up roll;

means on said path of travel for guiding said strip material through a bend which is sufficiently sharp to cause the labels to be peeled from said strip material as said strip material passes through said bend;

said advancing means comprising a driven roll rotatable about a first axis for driving contact with said strip material and means for intermittently driving said driven roll;

said intermittent drive means comprising a plurality of first formations rotatable about said first axis and uniformly distributed about said first axis, said first formations being secured for rotation with said driven roll, a drive member rotatable about a second axis of rotation, said drive member having a plurality of second formations uniformly distributed around only a portion of the periphery of said drive member and engageable in succession with said first formations on rotation of said drive member, braking means to inhibit rotation of said impression cylinder upon disengagement of said second formations from said first formations, whereby said driven roller remains stationary during passage of the remainder of the periphery of said drive member past said first formations, and means for rotating said drive member.

10. A label dispenser mechanism as claimed in claim 9, further comprising means for resiliently pressing said strip material against said driven roll.

* * * * *